US006501466B1

(12) United States Patent
Yamagishi et al.

(10) Patent No.: US 6,501,466 B1
(45) Date of Patent: Dec. 31, 2002

(54) ACTIVE MATRIX TYPE DISPLAY APPARATUS AND DRIVE CIRCUIT THEREOF

(75) Inventors: Machio Yamagishi, Kanagawa (JP); Akira Yumoto, Kanagawa (JP)

(73) Assignee: Sony Corporation (JP)

( * ) Notice: Subject to any disclaimer, the term of this patent is extended or adjusted under 35 U.S.C. 154(b) by 77 days.

(21) Appl. No.: 09/709,533

(22) Filed: Nov. 13, 2000

(30) Foreign Application Priority Data

Nov. 18, 1999 (JP) ..... 11-327637

(51) Int. Cl.[7] ..... G09G 5/00
(52) U.S. Cl. ..... 345/204; 345/82; 345/90
(58) Field of Search ..... 345/42, 55, 87, 345/90, 92, 93, 95, 99, 100, 204, 206, 214, 82–83; 349/42–43, 151

(56) References Cited

U.S. PATENT DOCUMENTS 5,952,789 A 9/1999 Stewart et al.

FOREIGN PATENT DOCUMENTS

| | | |
|---|---|---|
| EP | 0 905 673 | 3/1999 |
| EP | 0 917 127 | 5/1999 |
| WO | 98 48403 | 10/1998 |

*Primary Examiner*—Vijay Shankar
*Assistant Examiner*—Mansour M. Said
(74) *Attorney, Agent, or Firm*—Rader, Fishman & Grauer PLLC; Ronald P. Kananen

(57) ABSTRACT

Each of picture elements comprises an input transistor for accepting a signal current from a data line when a scanning line is selected, a conversion transistor for converting the signal current into a voltage and for holding thus converted voltage, and a drive transistor for driving a light emitting device with drive current corresponding to the converted voltage. The conversion transistor flows the signal current to its channel to generate the voltage corresponding to the converted voltage and a capacitor to restrain the generated voltage. Further the drive transistor flows the drive current corresponding to the voltage stored in the capacitor. In this case the threshold voltage of the drive transistor is set not to be smaller than the threshold voltage of the conversion transistor, and thereby a leakage current flowing through the light emitting device is suppressed.

28 Claims, 7 Drawing Sheets

ACTIVE MATRIX TYPE DISPLAY APPARATUS AND DRIVE CIRCUIT THEREOF

BACKGROUND OF THE INVENTION

1. Field of the Invention

This invention relates to a display apparatus which employs a plurality of light emitting elements such as organic electro-luminescence elements that are controlled in their intensity by currents flowing through each picture element. This invention is particularly relates to a display apparatus of a so-called active matrix type display apparatus in which an amount of current supplied to each light emitting element is controlled with active elements such as insulated gate type field effect transistors equipped in each picture element. This invention further relates to a drive circuit to be applied to such active matrix type display apparatus, wherein leakage current of sub-threshold level flowing through the insulated gate type field effect transistors is effectively suppressed.

2. Description of the Related Art

Generally, in a picture display apparatus of an active matrix type, a plurality of picture elements are arranged in a matrix form, and a video image is displayed by controlling intensity of each picture element according to given intensity information of the video image. A transmission factor of each picture element changes according to an applied voltage to each picture element when a liquid crystal device is used as an electro-optic material. In the picture display apparatus of the active matrix type employing organic materials as the electro-optic materials, the operation thereof is similar to the operation of the liquid crystal device. However different from the liquid crystal display, an organic EL (Electro-Luminescence) display is a so-called self-radiation type display having a light emitting device at each picture element, so that the EL display has advantages over the liquid crystal device as follows. Namely, a visibility of a video image is higher, a back-light is not necessary and a response speed thereof is faster than that of the liquid crystal display. Intensity of the individual light emitting device of the organic EL (Electro Luminescence) display is controlled by the amount of drive current. Namely, the organic EL display is greatly different from the liquid crystal display in the point that the light emitting device is a current control type or a current drive type element.

Similar to the liquid crystal display, the organic EL display can possibly take both a simple matrix type and an active matrix type as the drive system. In the simple matrix type drive system, the construction thereof is simple, but it is difficult to apply a large-scale display and a high definition display. Accordingly the development for the active matrix system is more active than for the simple matrix type system. In the active matrix system, the current flowing through the light emitting device of each picture element is controlled with an active element (Thin Film type Transistor (TFT) which is one of an insulated gate type field effect transistor) fabricated in the picture element. An example of one picture element in the organic EL display of this active matrix system is depicted in FIG. 6 as an equivalent circuit. Each picture element comprises a light emitting device OLED, a first thin film transistor TFT 1, a second thin film transistor TFT 2 and a retention capacitor C. The light emitting device is an organic electro-luminescence (EL) element. The most of the organic Electro-luminescence device has a rectification characteristic so that the EL element can be called an OLED (Organic Light Emitting Diode) device, and in this FIG. 6, a sign of a diode device is applied to a sign for the light emitting device OLED. The light emitting device is not limited to the OLED device, and another type light emitting element can be applied if the intensity of such element is controlled by the drive current flowing through the element. In addition, as the light emitting device, the rectification characteristic is not always demanded. In the figure, a source electrode of the P-channel type transistor TFT 2 is connected to a Vdd (power potential), a cathode electrode of the light emitting device OLED is connected to ground potential and an anode electrode of the light emitting device OLED is connected to a drain electrode of the P-channel type transistor TFT 2. On the other hand, a gate electrode of the N-channel type transistor TFT 1 is connected to a scanning line SCAN, a source electrode thereof is connected to a data line DATA and a drain electrode thereof is connected to both the retention capacitor C and a gate electrode of the transistor TFT 2.

At first the scanning line SCAN is made in selected status in order to drive the picture element, then a data potential (signal voltage) Vw representing an intensity information is given to the data line DATA. Then the transistor TFT 1 is made ON, thereby the retention capacitor C charges or discharges and a gate potential of the transistor TFT 2 becomes the data potential Vw. After that, the scanning line SCAN is made in non-selected status, and the transistor TFT 1 is accordingly made OFF. In this case, the transistor TFT 2 is separated electrically from the data line DATA, but the gate potential of the transistor TFT 2 is maintained stable by virtue of the retention capacitor C. A current flowing through the light emitting device OLED by way of the transistor TFT 2 corresponds to a value of a gate-source voltage Vgs of the transistor TFT 2, so that the light emitting device OLED continues to emit light with the intensity corresponding to the current amount supplied through the transistor TFT 2.

By the way, a current Ids flowing between the drain-source of the transistor TFT 2 is a drive current to be supplied to the light emitting device OLED. When the transistor TFT 2 works in a saturation range, the drive current Ids is shown with a following expression.

$$Ids=\mu\times Cox\times W/L\times(Vgs-Vth)^2/2$$

$$=\mu\times Cox\times W/L\times(Vw-Vth)^2/2 \quad (1)$$

Where the Cox is a gate capacitance of an unit area, and the Cox is given with the following expression.

$$Cox=\in 0\times\in r/d \quad (2)$$

In these expressions (1) and (2), Vth shows a threshold voltage of the transistor TFT 2, $\mu$ shows a mobility of a carrier, the W shows a channel width, L shows a channel length, $\in 0$ shows an electric constant, the $\in$ r shows a relative permittivity of a gate insulator film and the d is a thickness of the gate insulator film.

According to the expression (1), the drive current Ids can be controlled by the data potential Vw to be applied to the picture element. As a result, the intensity of the light emitting device OLED can be controlled in accordance with the drive current Ids. The reason for operating the transistor TFT 2 in the saturation range is explained as follows. Namely the drive current Ids is controlled only by the gate-source voltage Vgs of the transistor TFT 2 in the saturation range, and the drive current Ids does not depend on the drain-source voltage Vds of the transistor TFT 2.

Namely, even if the drain-source voltage Vds of the transistor TFT 2 changes by characteristic dispersion of the light emitting device OLED, a predetermined amount of the drive current Ids can be stably supplied to the light emitting device OLED.

As above described, in the circuit structure of the picture element as shown in FIG. 6, once the light emitting device OLED is supplied the signal voltage Vw, the light emitting device OLED continues to emit light with a constant intensity during one scan cycle (one frame) until the writing voltage is renewed next. As shown in FIG. 7, the active matrix type display apparatus is constituted by arranging a plurality of the picture elements, such as depicted in FIG. 6, in a matrix form. In the conventional active matrix type display apparatus; as shown in FIG. 7, scanning lines SCAN-1 to SCAN-N for selecting one picture element 25 with a predetermined scanning cycle (one frame of the NTSC standard) and data lines DATA for giving intensity information (the data potential Vw) to one picture element 25 are arranged in a matrix form. The scanning lines SCAN-1 to SCAN-N are connected to a scanning line drive circuit 21, and data lines DATA are connected to a data line drive circuit 22.

A desired video image can be displayed by repeating the supply of the data potential Vw through the data lines DATA by the data line drive circuit 22 while selecting scanning lines SCAN-1 to SCAN-N by the scanning line drive circuit 21. In a simple matrix type display apparatus, the light emitting device emits light at the moment when selected, but in a active matrix type display apparatus as shown in FIG. 7, the light emitting device of each picture element 25 continues to emit light even after finishing the selection, thereby a total amount of the drive current can be reduced in the active matrix type display apparatus compared with the simple matrix type display apparatus and this becomes profitable with a display apparatus of, in particular, a large-sized and a high definition type. Generally, in the active matrix type organic EL display, a TFT (Thin Film Transistor) device formed on the glass substrate is utilized as an active element, and this depends on the next reason. Namely, as the organic EL display is a direct viewing type display, the size of the display becomes comparatively large. Therefore it is not realistic to use a single crystal silicon substrate for fabricating an active element for the display due to the production cost the constraint of production facility.

Accordingly, in the active matrix type organic EL display, a comparatively large-sized glass substrate is used, and it is normal that the TFT device that is comparatively easy to form on the glass substrate is used as an active element. However, amorphous silicon and poly-silicon used for fabricating the TFT device show bad crystallization characteristics compared with single crystal silicon and controllability of conduction mechanism is bad, so that a fabricated TFT device shows a relatively large dispersion of characteristic. Particularly in the case where a poly-silicon TFT device is formed on a relatively large-sized glass substrate, a laser annealer is usually employed in order to avoid a problem of heat transformation of the glass substrate. But in this case, it is difficult to uniformly irradiate laser energy on the large-sized glass substrate, so that dispersion by the place for crystalline condition of poly-silicon is not avoided.

As a result, the threshold voltage Vth of the TFT device for a picture element shows a dispersion of several hundreds mV, or even more than 1V among the TFT devices formed on the same substrate. In this case, even if, for example, the same signal voltage Vw is supplied to different picture elements, the drive current Ids flowing through each OLED device differs from a desired value depending on the aforesaid expression (1) due to the dispersion of the threshold voltage Vth of the TFT device, so that as a result it can not be expected to obtain a display apparatus of high picture quality at all. This can say about dispersion of a carrier mobility $\mu$ and each parameter of the expression (1) are similar in addition to the threshold voltage Vth. In addition, the dispersion of each parameter as mentioned above is affected not only by the dispersion between the picture elements, but also affected by fabrication lot, every manufacturing lot or every product to some extent. In this case, it is necessary to decide setting for the signal voltage Vw in order to flow desired drive current Ids according to the completion of a product based on the parameters of the expression (1). But this is not only unrealistic in a mass production process of the display apparatus, but also very difficult to take measures to meet the situation for the change in characteristic drift of the TFT device by environmental temperature and change in properties with time for the TFT device produced by activity of a long term use.

SUMMARY OF THE INVENTION

This invention is producted to overcome the above-described problems and relates to an active matrix type display apparatus, a drive circuit for a picture element of the display apparatus and driving method to such an active matrix type display apparatus. One object of the invention is to present a new display apparatus capable of displaying a high quality image by supplying stable and precise desired drive current to a light emitting device of each picture element in spite of the characteristic dispersion of each active device of the picture element. In particular by suppressing leakage current of the sub-threshold level flowing through a transistor TFT (Thin Film Transistor) which drives an OLED (Organic Light Emitting Diode) device, the drive circuit of the invention prevents slight luminescence of the picture element by the leakage current.

In order to achieve the above object, the followings are applied. Namely a display apparatus of the present invention comprises a scanning line drive circuit for sequentially selecting scanning lines, a data line drive circuit which contains a current source for generating signal current having a current level corresponding to an intensity information and for supplying thus generated signal current sequentially to the data lines, and a plurality of picture elements each having a light emitting device of a current drive type which emits light with a supply of drive current, wherein the picture element is provided at each cross point of the data line and the scanning line. Each picture element comprises an accept section for accepting signal currents from a corresponding data line when selected, a converting section for converting accepted signal current once into a corresponding voltage level and restoring the voltage level and a drive section for supplying a drive current having a current level corresponding to the restored voltage level to the corresponding light emitting device. Further, the converting section includes the conversion, thin film transistor having a gate electrode, a source electrode, a drain electrode and a channel and a capacitor connected to the gate electrode of the transistor. The above mentioned conversion, thin film transistor generates at the gate electrode the voltage level converted by flowing through the channel the signal current taken through the accept section, and the capacitor holds the voltage level generated at the gate electrode. Furthermore, the above mentioned drive, section contains the drive, thin film transistor including a gate electrode, a drain electrode, a source electrode and a channel and the drive thin film transistor supplies, through the channel, the drive current to the light emitting device, wherein the drive current has a current level corresponding to the voltage level stored in the capacitor and accepted at the gate electrode of the transistor. The threshold voltage of the drive, thin film transistor is set not to become lower than the threshold voltage of the conversion thin film transistor corresponding to the picture element. To be concrete, the gate length of the drive, thin film transistor is set not to be shorter than the gate length of the conversion thin film transistor. Or, the thickness of a gate insulator of the drive, thin film transistor may be set not to be thinner than the thickness of the gate insulator of the conversion, thin film transistor, corresponding to the picture element. Further, the threshold voltage of the drive, thin film transistor may be set not to be lower than the threshold voltage of the conversion, thin film transistor corresponding to the picture element by adjusting the impurity density injected in the channel of the drive, thin film transistor. Preferably, the drive, thin film, insulated gate type, field effect transistor works in the saturation range and supplies drive current corresponding to the difference between the threshold voltage and the voltage level given to the gate electrode into the light emitting device. Further, a current mirror circuit is constituted by directly connecting the gate electrode of the drive, thin film transistor to the gate electrode of the conversion, thin film transistor, so that the current level of the signal current and the current level of the drive current are made to be a proportional relation. Further, the above mentioned accept section includes the switch, thin film transistor interposed between the drain electrode and the gate electrode of the conversion, thin film transistor and this switch thin film transistor is made ON when the current level of the signal current is converted into the voltage level, and generates at the gate electrode of the conversion, thin film transistor a voltage level referenced with the source electrode by electrically connecting the gate electrode and the drain electrode of the conversion, thin film transistor. Preferably, the organic electro-luminescence device (OLED) is employed as the light emitting device, and a thin film transistor (TFT), in which the source, the drain and the channel are formed with poly-crystal semiconductor thin films, is employed as the drive, insulated gate type, field effect transistor (FET) and the conversion, insulated, gate type field effect transistor.

A picture element drive circuit of this invention has the following features. Firstly, a writing of intensity information to the picture element is done by supplying the signal current corresponding to the intensity into the data line, and the signal current flows through the source-drain of the conversion, insulated, gate type, field effect transistor in the picture element and thereby generates a gate-source voltage corresponding to the signal current. Secondly, thus generated, gate-source voltage, or the gate voltage, is retained in an operation of the capacitance formed in the picture element or a capacitance existing parasitically, and is kept within a predetermined interval even after the completion of the writing of the intensity information to the picture element. Thirdly, the current flowing through the OLED device is controlled by the conversion, insulated gate type, field effect transistor connected thereto in series or the drive insulated gate type, field effect transistor that is in provided in addition in the picture element, and the gate electrode thereof is connected to the gate electrode of the conversion, field effect transistor. In this case, the gate-source voltage, upon driving the OLED device, is approximately equal to the gate-source voltage of the conversion, field effect transistor generated due to the above described first feature. Fourthly, the data line and the picture element are connected by the input, insulated, gate type, field effect transistor, which is controlled by a first scanning line, and the gate-drain of the conversion, insulated gate type, field effect transistor is short-circuited by the switch, insulated gate type, field effect transistor controlled by a second scanning line. Namely, by summing up the above described features, the most important feature is that the intensity information is given in the form of voltage a value in the conventional case, but the intensity information is given in the form of a current value, namely it is the current writing type in the display apparatus of the present invention.

Namely the object of the present invention is to flow a desired current precisely to the OLED device in spite of the characteristic dispersion of the transistor TFT as described already, the reason why this object can be achieved by the first to fourth features will be explained next. In the following explanation, the conversion insulated gate type field effect transistor is called a transistor TFT 1, the drive insulated gate type field effect transistor is called a transistor TFT 2, the input insulated gate type field effect transistor is called a transistor TFT 3 and the switch insulated gate type field effect transistor is called as a transistor TFT 4. But in the present invention, these transistors are not limited to thin film transistors, and an insulated gate type field effect transistor such as a single crystal silicon transistor made on a single crystal silicon substrate or a SOI (Silicon On Insulator) substrate can broadly adopt as an active element of the present invention. By the way, when writing the intensity information, the signal current to flow in the transistor TFT 1 is defined as a signal current Iw and as a result, voltage between the gate and the source electrodes of the transistor TFT 1 is defined as a voltage Vgs. The transistor TFT 1 works in the saturation range because the gate and drain electrodes of the transistor TFT 1 are short-circuited by the transistor TFT 4 during the writing operation. Thereby the signal current Iw is given with a following expression:

$$Iw=\mu 1\times Cox1\times W1/L1\times(Vgs-Vth1)^2/2 \quad (3)$$

Denotations of each parameter follow in the case of the aforesaid expression (1). When current flowing through the OLED is defined as Idrv, the Idrv current level is controlled by the thin film transistor TFT 2 connected to the OLED device in series. In this invention, the gate-source voltage of the transistor TFT 2 becomes the voltage Vgs in the expression (3), so that the following expression is established if the transistor TFT 2 works in its saturation range.

$$Idrv=\mu 2\times Cox2\times W2/L2\times(Vgs-Vth2)^2/2 \quad (4)$$

Denotations of each parameter follow it in the case of the aforesaid expression (1). Incidentally a condition for the thin film transistor of a insulated gate field effect type working in its saturation range is given with the following expression as the drain-source voltage of the thin film transistor is a voltage Vds:

$$|Vds|>|Vgs-Vth| \quad (5)$$

The transistors TFT 1 and TFT 2 are formed close to each other within a small picture element, so that approximately $\mu 1=\mu 2$ and Coxl=Cox2, and accordingly it is thought Vth 1=Vth 2 as long as no-particular idea is introduced in fabrication. Then the following expression is derived easily from expression (3) and the expression (4):

$$Idrv/Iw=(W2/L2)/(W1/L1) \quad (6)$$

It is very common for the values of $\mu$, Cox and Vth in expressions (3) and (4) to have dispersion among picture elements, display apparatus or product lot, but expression (6) does not include these parameters, so that the value of the Idrv/Iw does not depend on the dispersion of these parameters. If it is designed to be W1=W2 and L1=L2, the value of Idrv and the value of the Iw become the same value, namely Idrv/Iw=1. Namely the drive current Idrv flowing through the OLED device is precisely accorded with the signal current Iw in spite of the dispersion for the characteristics of these TFT devices, and thereby the luminescence intensity of the OLED device can be controlled precisely As described above, the Vthl of the conversion transistor TFT 1 and the Vth2 of the drive transistor TFT 2 are basically the same, so that both the transistors TFT 1 and TFT 2 are to be made OFF when a signal voltage for cutting off is supplied to the respective gates of both transistors TFT 1 and TFT 2. But practically due to the dispersion of parameters in respective picture elements, sometimes the Vth2 goes down below the Vthl. In this case, a leakage current corresponding to the sub-threshold level flows through the drive transistor TFT 2, so that the OLED device shows a minute luminescence. Because of this minute luminescence, the contrast of the displayed image is lowered and the display characteristics are deteriorated. According to the present invention, it is particularly set that the threshold voltage Vth2 of the drive transistor TFT 2 does not become lower than the threshold voltage Vth1 of the corresponding conversion transistor TFT 1 within the picture element. For example the gate length L2 of the drive transistor TFT 2 is set to be longer than the gate length L1 of the conversion transistor TFT 1 in order to ensure that the threshold voltage Vth2 of the drive transistor TFT 2 does not become lower than the threshold voltage Vth1 of the corresponding conversion transistor TFT 1. Thereby it is possible to suppress the above mentioned minute leakage current and minute luminescence.

DESCRIPTION OF THE PREFERRED EMBODIMENTS

Figure 1:
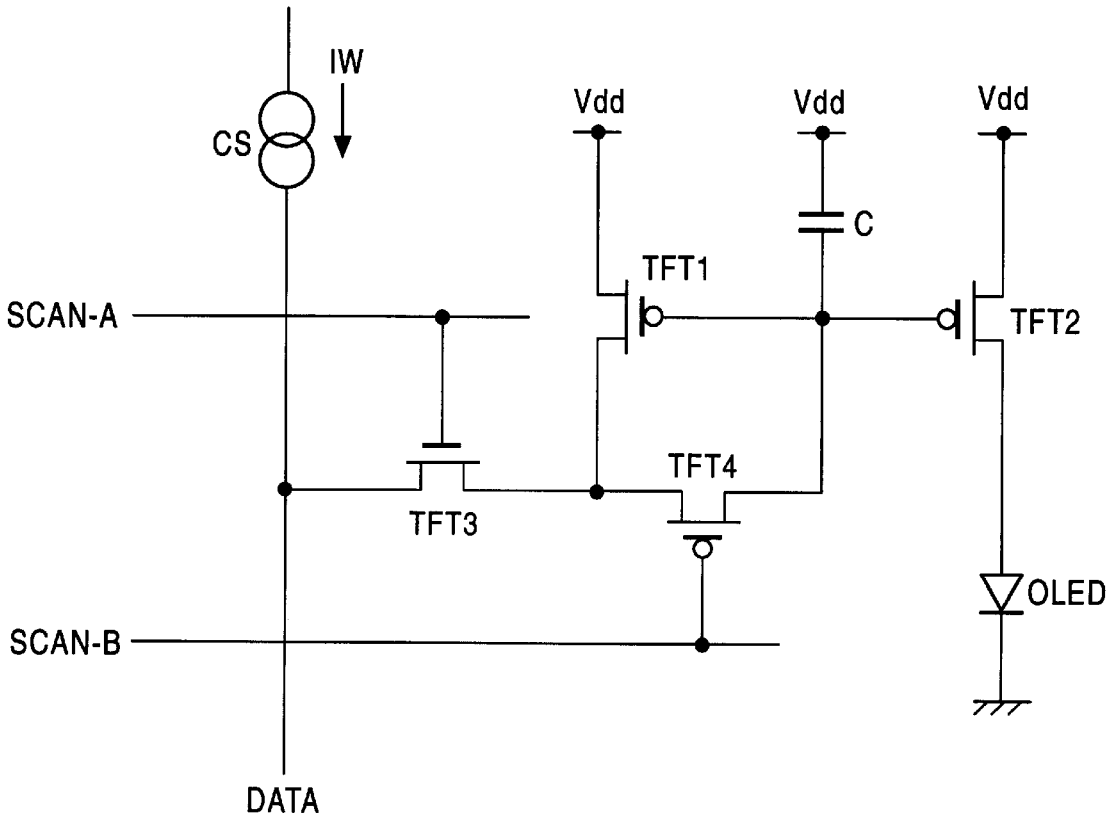
FIG. 1 is a circuit diagram showing one embodiment of a picture element drive circuit of the present invention.

FIG. 1 is an example of a picture element drive circuit according to the present invention. In this figure, the picture element drive circuit includes a conversion thin film transistor TFT 1, where the signal current flows through the transistor TFT 1, and a drive thin film transistor TFT 2 for controlling the drive current flowing through a light emitting device consisting of an organic electro-luminescence device. In addition, the picture element drive circuit further includes an input thin film transistor TFT 3 for connecting and disconnecting the picture element drive circuit to/from a data line DATA consisting of Mo-Ta in accordance with a control signal supplied from a first scan line SCAN-A consisting of Al, a switch thin film transistor TFT 4 for connecting a gate electrode and a drain electrode of the conversion transistor TFT 1 in accordance with a control signal supplied from a second scan line SCAN-B consisting of Mo—Ta during a writing period, a capacitor C having a structure the same as a metal oxide semiconductor structure of the TFT 1 for maintaining a gate-source voltage of the conversion transistor TFT 1 after completion of the writing period and a light emitting device OLED (Organic Light Emitting Device). In the case of FIG. 1, the input transistor TFT 3 is an NMOS (N-channel Metal Oxide semiconductor) transistor and the other transistors are PMOS (P-channel Metal Oxide Semiconductor) transistors, but those are not a limitation of the scope of the invention. As for the capacitor C, one of the terminals is connected to a gate electrode of the conversion transistor TFT 1 and the other terminal is connected to a potential Vdd (power potential), but terminal connector is not limited to the power potential Vdd and any arbitrary fixed potential is available. A cathode electrode of the light emitting device OLED is connected to a ground potential.

The display apparatus of the present invention basically comprises a scanning line drive circuit for sequentially selecting scanning lines SCAN-A and SCAN-B, a data line drive circuit including a current source CS for generating a signal current Iw having a current level corresponding to intensity information and for supplying the signal current lw sequentially to the data line DATA and a plurality of picture elements including a current drive type light emitting device OLED provided at crossing portions of each scanning lines SCAN-A, SCAN-B and each data line DATA for emitting light in accordance with the received drive current. As a special feature, the picture element as shown in FIG. 1 comprises an accept section for accepting the signal current Iw from the corresponding data line DATA when the corresponding scanning line SCAN-A is selected, a converting section for converting the accepted signal current Iw once into a corresponding voltage level and restoring the voltage level and a drive section for supplying the drive current having a current level corresponding to the restored for supplying the drive current having current level corresponding to the restored voltage level to the corresponding light emitting device OLED. To be concrete the above mentioned accept section consists of the input transistor TFT 3. Further the converting section includes the conversion thin film transistor TFT 1 having, as above mentioned, the gate electrode, the source electrode, the drain electrode and a channel and the capacitor C connected to the gate electrode of the transistor TFT 1.

The conversion thin film transistor TFT 1 generates at the gate electrode the voltage converted by flowing through the channel the signal current Iw taken and the capacitor C restores the voltage thus generated at the gate electrode of the transistor TFT 1. Further the above mentioned accept section includes the switch thin film transistor TFT 4 interposed between the drain electrode and the gate electrode of the conversion thin film transistor TFT 1. This switch thin film transistor TFT 4 is made ON when the current level of the signal current Iw is converted into the voltage level, and generates at the gate electrode of the conversion thin film transistor TFT 1 the voltage referenced with the source electrode by electrically connecting the gate electrode and the drain electrode of the conversion thin film transistor TFT 1. In addition, the switch thin film transistor TFT 4 is made OFF when restoring the voltage in the capacitor C and the transistor TFT 4 disconnects the gate electrode of the conversion thin film transistor TFT 1 and the capacitor C connected thereto from the drain electrode of the conversion thin film transistor TFT 1.

Furthermore, the above mentioned drive section contains the drive thin film transistor TFT 2 including the gate electrode, the drain electrode, the source electrode and a channel. The drive thin film transistor TFT 2 supplies the drive current, through the channel to the light emitting device OLED, wherein the drive current has the current level corresponding to the voltage level stored in the capacitor C and accepted at the gate electrode of the transistor TFT 2. A current mirror circuit is constituted by directly connecting the gate electrode of the drive thin film transistor TFT 2 to the gate electrode of the conversion thin film transistor TFT 1, so that the current level of the signal current Iw and the current level of the drive current are made to be proportional. In this case, the drive thin film transistor TFT 2 works in the saturation range, and the transistor TFT 2 flows the drive current corresponding to the difference between the voltage level given to the gate electrode and the threshold voltage to the light emitting device OLED.

As another special feature matter of this invention, the threshold voltage of the drive thin film transistor TFT 2 is set not to become lower than the threshold voltage of the conversion thin film transistor TFT 1 within the picture element. To be more concrete, the gate length of the transistor TFT 2 is set not to be shorter than gate length of the transistor TFT 1. The thickness of a gate insulating film of the transistor TFT 2 may be set not to be thinner than the thickness of a gate insulating film of the transistor TFT 1 corresponding to the picture element. Further the threshold voltage of the transistor TFT 2 may be set not to be lower than the threshold voltage of the transistor TFT 1 within the picture element by adjusting the impurity density injected in the channel of the transistor TFT 2 in the process of fabrication. If the threshold voltage Vth1 of the conversion transistor TFT 1 and the threshold voltage Vth2 of the drive transistor TFT 2 are set to be same, both the transistors TFT 1 and TFT 2 are made OFF when a signal voltage for cutting off is supplied to commonly connected gate electrodes of both transistors TFT 1 and TFT 2. But practically due to the dispersion of process parameters in respective picture element, there occurs the case where the threshold voltage Vth2 of the transistor TFT 2 goes down below the threshold voltage Vth1 of the transistor TFT 1. In this case, a leakage current corresponding to a sub-threshold level flows through the drive transistor TFT 2 even by the signal voltage of below the cut off level, so that the OLED device shows a minute luminescence and the contrast of the displayed image is lowered. Accordingly in the present invention, the gate length L2 of the drive transistor TFT 2 is set to be longer than the gate length L1 of the conversion transistor TFT 1. Thereby even if the process parameters of the thin film transistor change within the picture element, the threshold voltage Vth2 of the transistor TFT 2 does not become lower than the threshold voltage Vth1 of transistor TFT 1.

Figure 2:
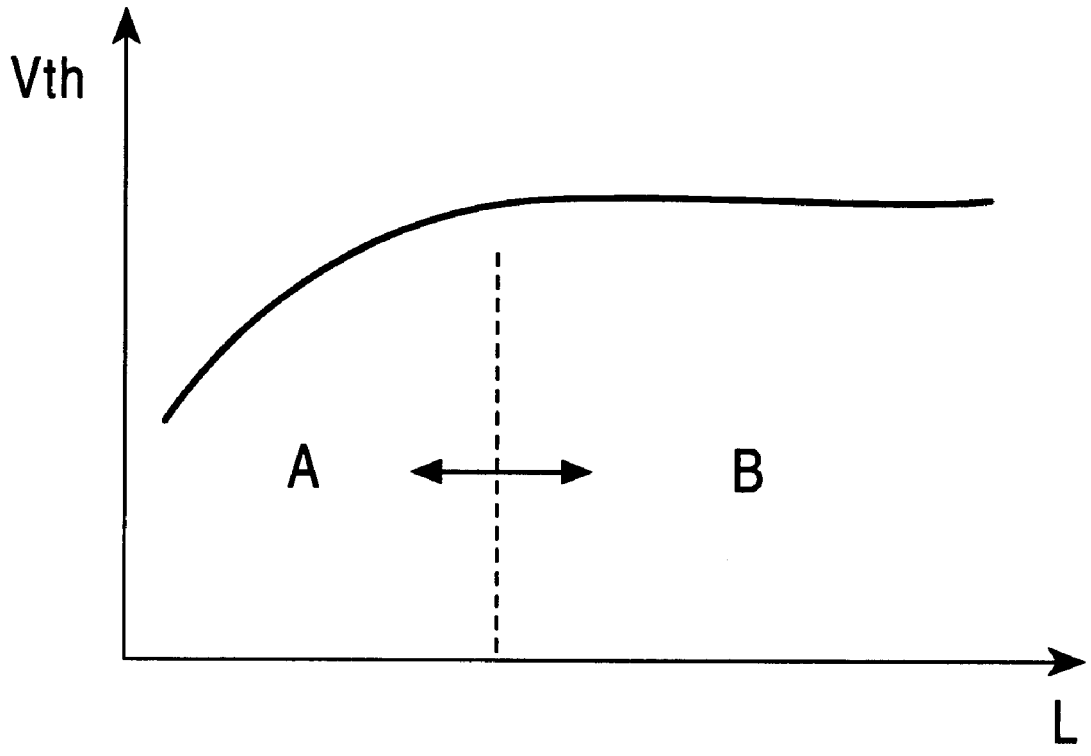
FIG. 2 is a graph chart showing a relation between a threshold voltage and a gate length of a thin film transistor.

FIG. 2 is a graph chart showing a relation between a threshold voltage Vth and a gate length L of a thin film transistor. In a short-channel effect area A where the gate length L is relatively short, the threshold voltage Vth becomes high as the gate length L increases. On the other hand in a suppression area B where the gate length L is relatively long, the threshold voltage Vth is almost fixed in spite of the gate length L. By utilizing this characteristic, the gate length L2 of the transistor TFT 2 is made longer than the gate length L1 of the transistor TFT 1 in this invention. For example, the gate length L1 of the transistor TFT 1 is set to be 7 $\mu$m, and then the gate length L2 of the transistor TFT 2 is set to be about 10 $\mu$m. The gate length L1 of the transistor TFT 1 belongs to the short-channel effect area A, and the gate length L2 of the transistor TFT 2 belongs to the suppression area B. Thereby, not only the short channel effect in the transistor TFT 2 can be suppressed, but also it is possible to suppress Accordingly, the minute luminescence of the OLED device is restrained by suppressing the leakage current of the sub-threshold level flowing through the transistor TFT 2, and thereby this can contribute to the contrast improvement of the active matrix type display apparatus. To be more concrete, when mask patterns are designed for fabrication, this idea is taken in consideration, so that the gate length L2 of the transistor TFT 2 is set to be longer than the gate length L1 of the transistor TFT 1 without requiring any extra fabrication process.

Figure 3:
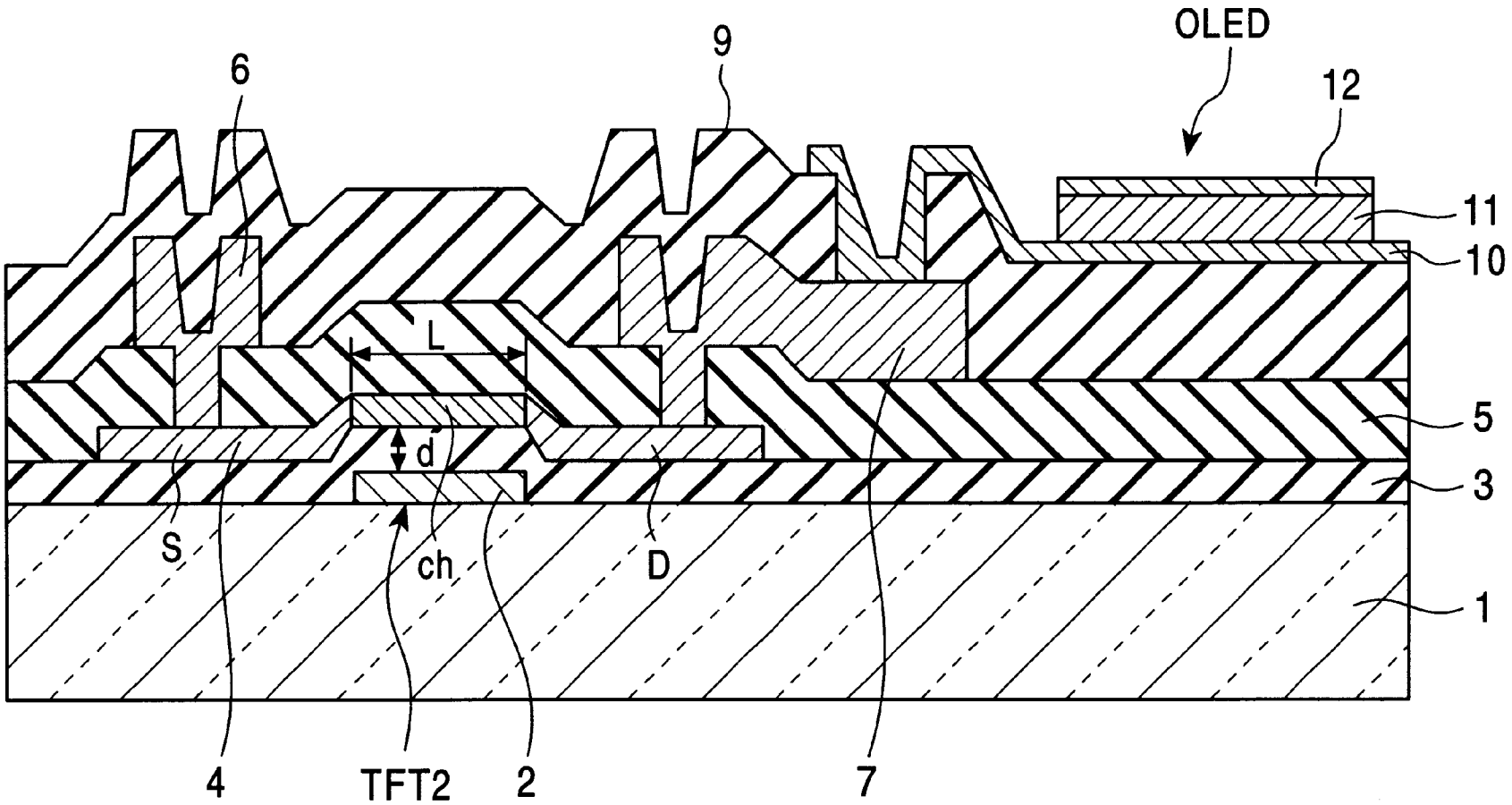
FIG. 3 is a sectional view showing a construction of a display apparatus of this invention.

FIG. 3 is a sectional view showing a construction of the display apparatus of this invention. Only the OLED device and the transistor TFT 2 are depicted in FIG. 3 for simplicity. The OLED device is formed by sequentially superimposing a reflection electrode 10 made, for example of Mg—Ag, an organic EL layer 11 and a transparent electrode 12 made of ITO (Indium Tin Oxide). The reflection electrode 10 is separated by one picture element and functions to be the anode electrode of the OLED device. Each of the transparent electrodes 12 is commonly connected between the picture elements and functions the cathode electrode of the OLED device. Namely each of the transparent electrode 12 is commonly connected to the predetermined power potential Vdd. The organic EL layer 11 is a complex film formed. by superimposing a positive hole transport layer and an electron transport layer. Diamyne is evaporated on the transparent electrode 10 functioning as the anode electrode (a positive hole injection electrode), Alq3 is evaporated thereon as the electron transport layer and finally the transparent electrode 12 is formed on the Alq3 functioning as the cathode electrode (an electron injection electrode). The above mentioned Alq3 represents an 8-hydroxy quinoline aluminum. The OLED device having such laminated structure is only one example and this invention is not limited by the depicted structure. When a forward direction voltage of around 10V is supplied between the anode electrode and the cathode electrode of the OLED device having configuration as described above, injection of carriers such as the electron or the positive hole occurs and the luminescence is observed. The luminescent operation of the OLED device is thought to be based on an excitation formed by both the positive hole injected from the positive hole transport layer and the electron injected from the electron transport layer.

On the other hand the transistor TFT 2 comprises of the gate electrode 2 consisting of Mo—Ta formed on a glass substrate 1, a gate insulating film 3 formed thereon and consisting of $SiO_2$ and a semiconductor thin film 4 formed on the gate insulating film 3 and above the gate electrode 2. This semiconductor thin film 4 consists of a polycrystalline silicon thin film re-crystallized by a laser. The transistor TFT 2 equiped with a source S, a channel Ch and a drain D serves as a transistor TFT 2 equips with a source S, a channel Ch and a drain D served as a passage of the current to be supplied to the OLED device. The channel Ch is positioned just above the gate electrode 2. The transistor TFT 2 of this bottom gate structure is covered with an inter-layer insulating film 5 consisting of, for example, a PSG (Phosphosilicate Glass), and a source electrode 6 and a drain electrode 7 respectively consisting of Al are formed thereon. The OLED device as described above is formed thereon by way of another inter-layer insulating film 9 consisting of SiN. In the embodiment of FIG. 3, a P-channel thin film transistor is formed as the transistor TFT 2, because the anode electrode of the OLED device is connected to the drain electrode of the transistor TFT 2.

The gate length L2 of the transistor TFT 2 is set to become longer than the gate length L1 of the transistor TFT 1. Or the thickness d of the gate insulator 3 of the transistor TFT 2 may set to become thicker than the thickness of the gate insulator of the transistor TFT 1. The threshold voltage of a thin film transistor becomes larger as the thickness of a gate insulator becomes thicker. To be more concrete, when the thickness of the gate insulator of the transistor TFT 1 is set to be 200 nm, the threshold voltage can be adjusted within several hundreds mv if the thickness d of the gate insulator 3 of the transistor TFT 2 is set to be 220 nm. In this case, adjustment of the thickness of the gate insulator may be done by an etching process and photolithography. In some cases, the threshold voltage may be adjusted by selectively injecting an impurity in the channel Ch of the transistor TFT 2. In the case where the transistor TFT 2 is a P-channel type, an impurity of P or As is selectively injected into the channel Ch in order to shift the threshold voltage Vth2 toward the enhancement side. The constructions of the transistors TFT 1, TFT 3 and TFT 4 are basically the same as the transistor TFT 2 except that the OLED device, the organic EL layer and transparent electrode are not provided.

Figure 4:
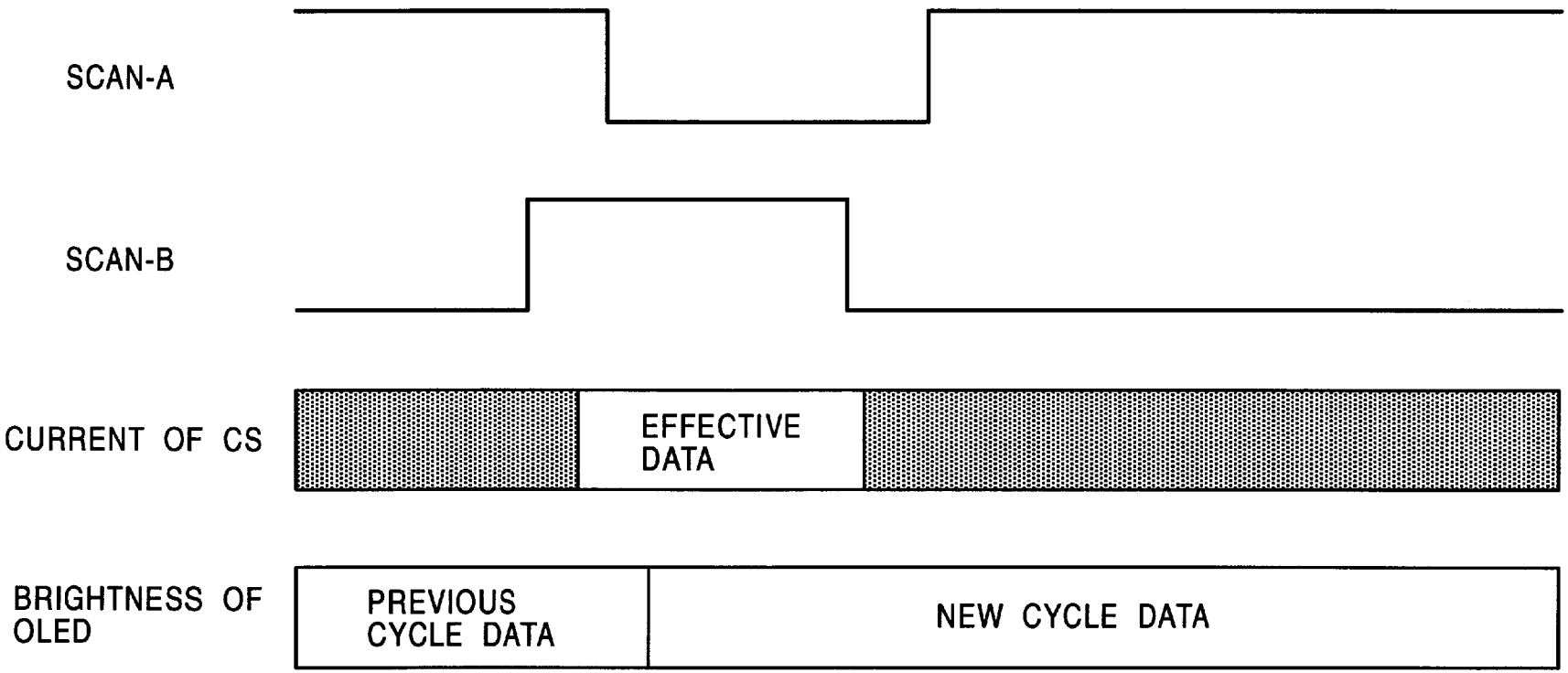
FIG. 4 is a waveform chart showing waveforms of each signal in the picture element drive circuit depicted in FIG. 1.

Next, with reference to FIG. 4, a drive method of the picture element drive circuit depicted in FIG. 1 is explained briefly. First of all, the first scanning line SCAN-A and the second scanning line SCAN-B are set at the selected status when writing. In the case of FIG. 4, the first scanning line SCAN-A is set at the low level and the second scanning line SCAN-B is set at the high level. The signal current Iw corresponding to the intensity information flows through the transistor TFT 1 by connecting the current source CS to the data line DATA while both scanning lines SCAN-A and SCAN-B are in the selected condition. The current source CS is a variable current source controlled in accordance with the intensity information. In this time, the previously mentioned expression (5) is established because the gate-drain of the transistor TFT 1 is short-circuited by the transistor TFT 4, so that the transistor TFT 1 works in the saturation range. Accordingly the voltage Vgs given by the expression (3) occurs between the gate-source of the transistor TFT 1. Next, the first scanning line SCAN-A and the second scanning line SCAN-B are set at the non-selected status. Namely in more detail, the transistor TFT 4 is set at the OFF condition by setting the second scanning line SCAN-B at the low level. Thereby the voltage Vgs is restored in the capacitor C. Then the picture element drive circuit is electrically disconnected from the data line DATA by making the transistor TFT 3 is the OFF condition by setting the first scanning line SCAN-A to be the high level, so that the writing to the other picture element drive circuit can be possible after-words through the data line DATA. The data to be outputted as the current level of the signal current by the current source CS has to be effective when the second scanning line SCAN-B is in the nonselected selected condition, but afterwards may be an arbitrary level (the writing data for the next picture element, for example). The gate and source electrodes of the transistor TFT 2 are commonly connected to the source electrodes of the transistor TFT 1, and those electrodes are formed closely to each other within the small picture element circuit, so that the current flowing through the transistor TFT 2 is determined by the expression (4) if the transistor TFT 2 works in the saturation range. This current determined by the expression (4) becomes the drive current Idrv flowing through the OLED device. In order to work transistor TFT 2 in the saturation range, it is only necessary to supply sufficient power potential as the power voltage Vdd so as to establish the expression (5) even considering the voltage drop at the OLED device.

Figure 5:
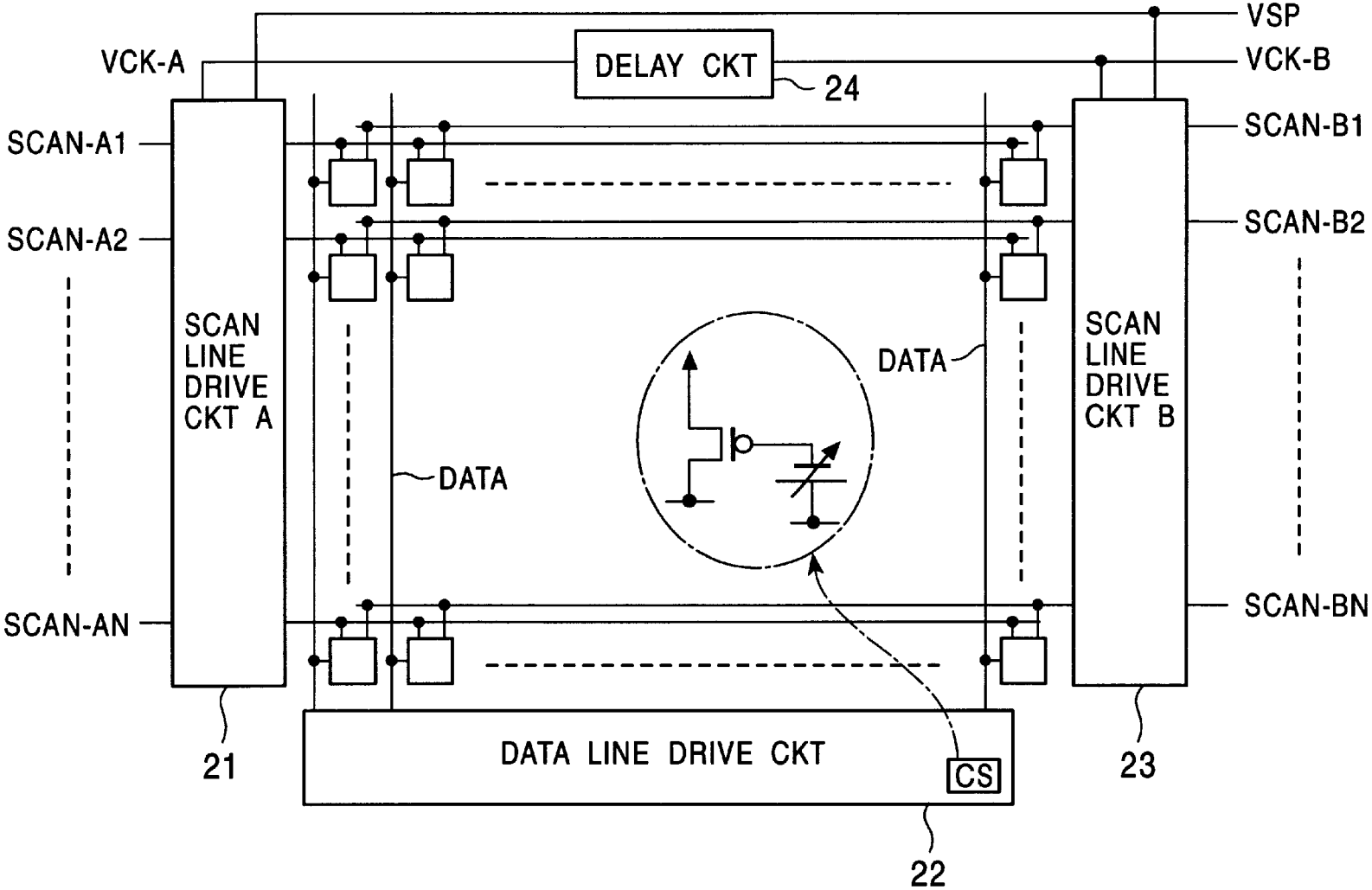
FIG. 5 is a block diagram showing a construction example of the display apparatus to which the picture element drive circuit of FIG. 1 is applied.
Figure 6:
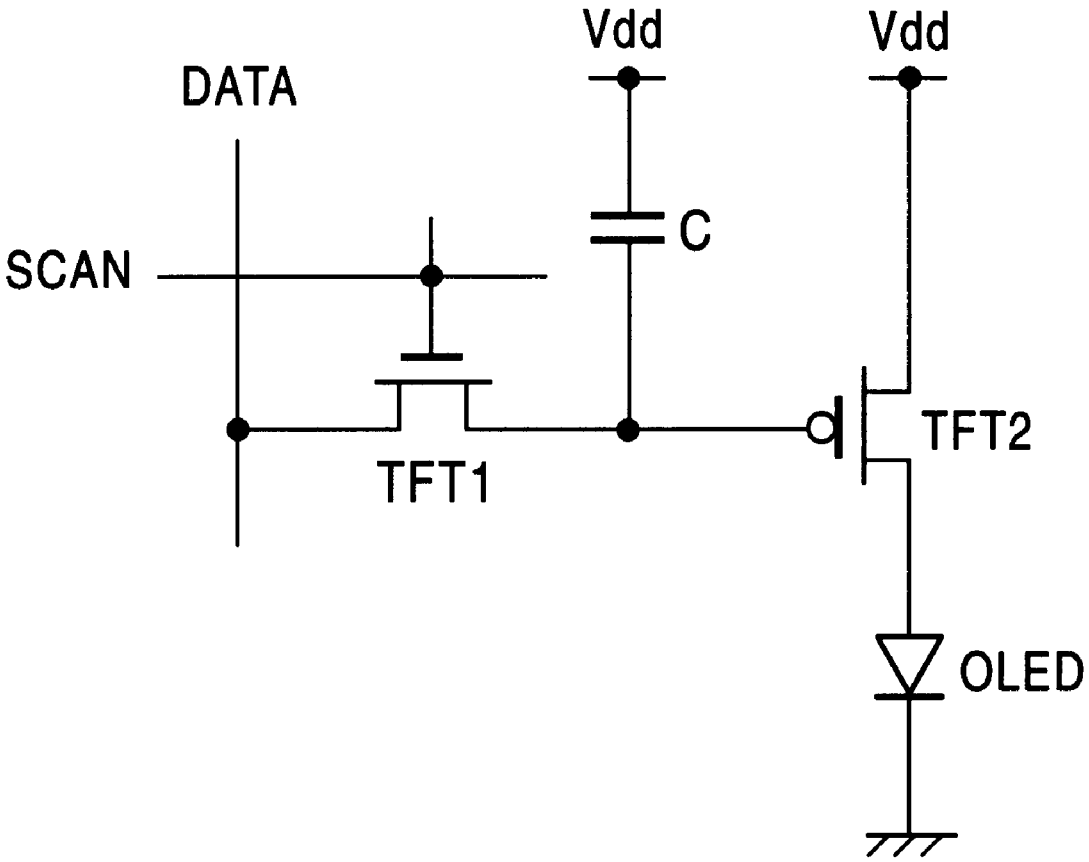
FIG. 6 is a conventional picture element drive circuit.
Figure 7:
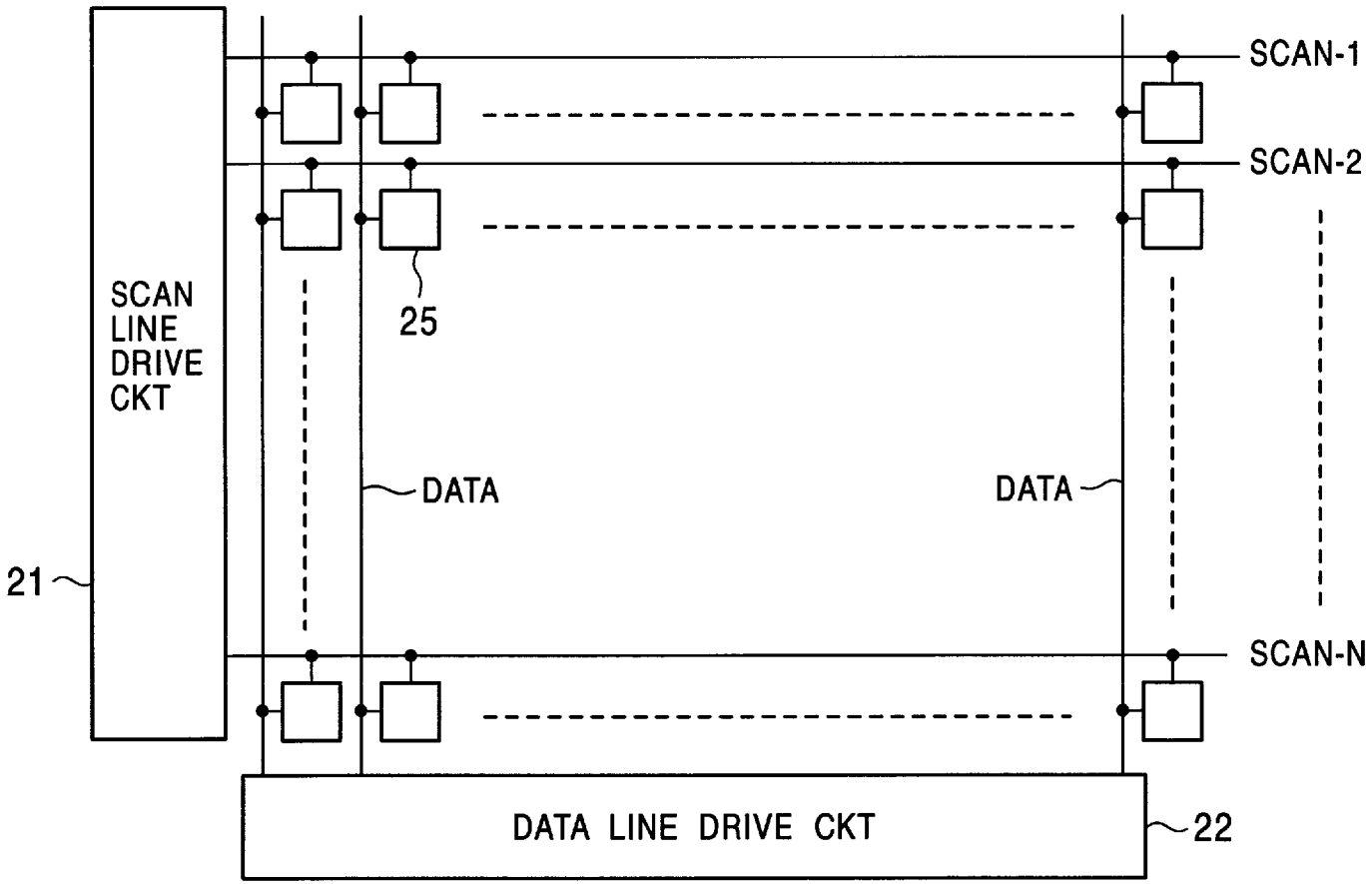
FIG. 7 is a block diagram showing a construction example of a conventional display apparatus to which the picture element drive circuit of FIG. 6 is applied.

FIG. 5 is a block diagram showing a construction example of the display apparatus to which the picture element drive circuit of FIG. 1 is applied. The operation of the display apparatus is explained as follows. First of all, a vertical start pulse (VSP) is supplied to the scanning line drive circuit A21 consists of thin film transistors and including a shift register and to the scanning line drive circuit B23 constituted of thin film transistors and including a shift register. These scanning line drive circuits A21 and B23 select the first scanning line SCAN-A1~SCAN-AN and the second scanning line SCAN-B1~SCAN-BN sequentially in synchronization with vertical clocks (VCKA, VCKB) after receiving the vertical start pulse (VSP). The current source CS is provided in the data line drive circuit 22 constituted of thin film transistors, and the current source CS drives the data line DATA with the current level corresponding to the intensity information. The current source CS is constituted by a voltage-current converting circuit as briefly depicted in a circle in FIG. 5 and outputs the signal current in response to the voltage representing the intensity information. The signal current flows to the picture element on the selected scanning line and is written by the scanning line unit. Each of the picture elements starts luminescence by the strength corresponding to the current level. In this case, the vertical clocks VCKA are slightly delayed relative to the vertical clocks VCKB by a delay circuit 24. Thereby, the second scanning line is set at the non-selected condition in advance of the first scanning line.

What is claimed is:

1. An active matrix type display apparatus comprising:

a scanning line drive circuit for sequentially selecting scanning lines;

a data line drive circuit containing a current source for generating signal current having current level corresponding to an intensity information and for sequentially supplying thus generated signal current to "data lines"; and a plurality of picture elements provided at each cross point of said "data line" and said scanning line and each of the picture elements having a current drive type light emitting device which emits light in response to drive current, wherein each of said picture element comprises:

an accept section for accepting said signal current from the corresponding data line when a corresponding scanning line is selected;

a converting section for converting a current level of thus accepted signal current once into corresponding voltage and restoring the converted voltage; and a drive section for supplying the drive current having a current level corresponding to the restored voltage to the corresponding light emitting device, said converting section includes:

a conversion thin film transistor having a gate electrode, a source electrode, a drain electrode and a channel; and a capacitor connected to said gate electrode of the conversion thin film transistor, wherein said conversion thin film transistor generates at the gate electrode the voltage converted by flowing through said channel the signal current taken through said accept section and said capacitor holds the voltage generated at the gate electrode, said drive section contains:

a drive thin film insulated gate type field effect transistor including a gate electrode, a drain electrode, a source electrode and a channel, wherein said drive thin film insulated gate type field effect transistor supplies the drive current through the channel to the light emitting device and the drive current has the current level corresponding to the voltage restored in said capacitor and accepted at the gate electrode of the drive thin film insulated gate type field effect transistor, and a threshold voltage of said drive thin film insulated gate type field effect transistor is set not to become lower than a threshold voltage of said conversion thin film insulated gate type field effect transistor corresponding to the picture element.

2. The active matrix type display apparatus as claimed in claim 1, wherein a gate length of said drive thin film insulated gate type field effect transistor is set not to be shorter than a gate length of said conversion thin film insulated gate type field effect transistor within one picture element.

3. The active matrix type display apparatus as claimed in claim 1, wherein a thickness of a gate insulator of said drive thin film insulated gate type field effect transistor is set not to be thinner than a thickness of a gate insulator of said conversion thin film insulated gate type field effect transistor within one picture element.

4. The active matrix type display apparatus as claimed in claim 1, wherein a threshold voltage of said drive thin film transistor is set not to be lower than a threshold voltage of said conversion thin film insulated gate type field effect transistor within one picture element by adjusting impurity density injected in said channel of the drive thin film insulated gate type field effect transistor.

5. The active matrix type display apparatus as claimed in claim 1, wherein said drive thin film insulated gate type field effect transistor works in a saturation range and supplies the drive current corresponding to the difference between the threshold voltage and the voltage given to the gate electrode into the light emitting device.

6. The active matrix type display apparatus as claimed in claim 1, wherein a current mirror circuit is constituted by directly connecting the gate electrode of said drive thin film insulated gate type field effect transistor to the gate electrode of the conversion thin film insulated gate type field effect transistor, so that the current level of the signal current and the current level of the drive current are made to be a proportional relation.

7. The active matrix type display apparatus as claimed in claim 1, wherein said accept section includes a switch thin film insulated gate type field effect transistor interposed between the drain electrode and the gate electrode of the conversion thin film insulated gate type field effect transistor, said switch thin film insulated gate type field effect transistor is made ON when the current level of the signal current is converted into the voltage and then generates at the gate electrode of the conversion thin film insulated gate type field effect transistor said voltage referenced with the source electrode by electrically connecting the gate electrode and the drain electrode of the conversion insulated gate type field effect thin film transistor, and said switch thin film insulated gate type field effect transistor is made OFF to disconnect the gate electrode of the conversion thin film insulated gate type field effect transistor and the capacitor when restoring the voltage to said capacitor.

8. The active matrix type display apparatus as claimed in claim 1, wherein said light emitting device is an organic electroluminescence device.

9. The active matrix type display apparatus as claimed in claim 1, wherein said source, drain and channel of both said drive thin film insulated gate type field effect transistor and said conversion thin film insulated gate type field effect transistor are formed with poly-crystal semiconductor thin films.

10. A picture element drive circuit to be provided at each cross point of a data line for supplying a signal current having current level corresponding to an intensity information and a scanning line for supplying a selecting pulse and for driving a current drive type light emitting device which emits light by a drive current, comprising:

an accept section for accepting said signal current from the corresponding data line in response to said selecting pulse from said scanning line;

a converting section for converting thus accepted signal current once into corresponding voltage and restoring thus converted voltage; and a drive section for supplying the drive current having current level corresponding to the restored voltage to the corresponding light emitting device, and said converting section includes:

a conversion thin film transistor having a gate electrode, a source electrode, a drain electrode and a channel; and a capacitor connected to said gate electrode of the conversion thin film transistor, wherein the conversion thin film transistor generates at the gate electrode the voltage converted by flowing through said channel the signal current taken through said accept section and said capacitor holds the voltage generated at the gate electrode of the conversion thin film transistor, said drive section contains:

a drive thin film insulated gate type field effect transistor including a gate electrode, a drain electrode, a source electrode and a channel and the drive thin film insulated gate type field effect transistor, wherein the drive thin film insulated gate type field effect transistor supplies the drive current through the channel to the light emitting device and the drive current has the current level corresponding to the voltage restored in the capacitor and accepted at the gate electrode of the drive thin film insulated gate type field effect transistor, and a threshold voltage of said drive thin film insulated gate type field effect transistor is set not to become lower than a threshold voltage of said conversion thin film insulated gate type field effect transistor corresponding to the picture element.

11. The picture element drive circuit as claimed in claim 10, wherein a gate length of said drive thin film insulated gate type field effect transistor is set not to be shorter than a gate length of said conversion thin film insulated gate type field effect transistor within one picture element.

12. The picture element drive circuit as claimed in claim 10, wherein a thickness of a gate insulator of said drive thin film insulated gate type field effect transistor is set not to be thinner than a thickness of a gate insulator of said conversion thin film insulated gate type field effect transistor within one picture element.

13. The picture element drive circuit as claimed in claim 10, wherein a threshold voltage of said drive thin film transistor is set not to be lower than a threshold voltage of said conversion thin film insulated gate type field effect transistor within one picture element by adjusting impurity density injected in said channel of the drive thin film insulated gate type field effect transistor.

14. The picture element drive circuit as claimed in claim 10, wherein said drive thin film insulated gate type field effect transistor works in saturation range and supplies the drive current corresponding to the difference between the threshold voltage and the voltage given to the gate electrode into the light emitting device.

15. The picture element drive circuit as claimed in claim 10, wherein a current mirror circuit is constituted by directly connecting the gate electrode of said drive thin film insulated gate type field effect transistor to the gate electrode of the conversion thin film insulated gate type field effect transistor, so that the current level of the signal current and the current level of the drive current are made to be a proportional relation.

16. The picture element drive circuit as claimed in claim 10, wherein said accept section includes a switch thin film insulated gate type field effect transistor interposed between the drain electrode and the gate electrode of the conversion thin film insulated gate type field effect transistor, said switch thin film insulated gate type field effect transistor is made ON when the current level of the signal current is converted into the voltage and generates at the gate electrode of the conversion thin film insulated gate type field effect transistor said voltage referenced with the source electrode by electrically connecting the gate electrode and the drain electrode of the conversion insulated gate type field effect thin film transistor, and said switch thin film insulated gate type field effect transistor is made OFF to disconnect the gate electrode of the conversion thin film insulated gate type field effect transistor and the capacitor when restoring the voltage to said capacitor.

17. The picture element drive circuit as claimed in claim 10, wherein said light emitting device is an organic electroluminescence device.

18. The picture element drive circuit as claimed in claim 10, wherein said source, drain and channel of both said drive thin film insulated gate type field effect transistor and said conversion thin film insulated gate type field effect transistor are formed with poly-crystal semiconductor thin films.

19. A method for driving picture element to be provided at each cross point of a data line for supplying a signal current having a current level corresponding to an intensity information and a scanning line for supplying a selecting pulse and for driving a current drive type light emitting device which emits light by a drive current, comprising the steps of:

step for accepting said signal current from the corresponding data line in response to said selecting pulse from corresponding scanning line;

step for converting thus accepted signal current once into corresponding voltage and restoring the voltage; and step for driving by supplying the drive current having the current level corresponding to the restored voltage to the corresponding light emitting device, and said converting step includes:

step for using a conversion thin film transistor having a gate electrode, a source electrode, a drain electrode and a channel; and a capacitor connected to said gate electrode of the conversion thin film transistor, wherein the conversion thin film transistor generates at the gate electrode the voltage converted by flowing through said channel the signal current taken through said accepting step and said capacitor holds the voltage generated at the gate electrode, said driving step includes:

step for using a drive thin film insulated gate type field effect transistor having a gate electrode, a drain electrode, a source electrode and a channel, wherein said the drive thin film insulated gate type field effect transistor supplies the drive current through the channel to the light emitting device, wherein the drive current has the current level corresponding to the voltage stored in the capacitor and accepted at the gate electrode of the drive thin film insulated gate type field effect transistor, and a threshold voltage of said drive thin film insulated gate type field effect transistor is set not to become lower than a threshold voltage of said conversion thin film insulated gate type field effect transistor corresponding to the picture element.

20. The method for driving a picture element as claimed in claim 19, wherein a gate length of said drive thin film insulated gate type field effect transistor is set not to be shorter than a gate length of said conversion thin film insulated gate type field effect transistor within one picture element.

21. The method for driving a picture element as claimed in claim 19, wherein a thickness of a gate insulator of said drive thin film insulated gate type field effect transistor is set not to be thinner than thickness of a gate insulator of said conversion thin film insulated gate type field effect transistor within one picture element.

22. The method for driving a picture element as claimed in claim 19, wherein a threshold voltage of said drive thin film transistor is set not to be lower than a threshold voltage of said conversion thin film insulated gate type field effect transistor within one picture element by adjusting impurity density injected in said channel of the drive thin film insulated gate type field effect transistor.

23. The method for driving picture element as claimed in claim 19, wherein said drive thin film insulated gate type field effect transistor works in saturation range and supplies the drive current corresponding to the difference between the threshold voltage and the voltage given to the gate electrode into the light emitting device.

24. The method for driving picture element as claimed in claim 19, wherein a current mirror circuit is constituted by directly connecting the gate electrode of said drive thin film insulated gate type field effect transistor to the gate electrode of the conversion thin film insulated gate type field effect transistor, so that the current level of the signal current and the current level of the drive current are made to be a proportional relation.

25. The method for driving picture element as claimed in claim 19, wherein said accepting step includes a step for using a switch thin film insulated gate type field effect transistor interposed between the drain electrode and the gate electrode of the conversion thin film insulated gate type field effect transistor, wherein said switch thin film insulated gate type field effect transistor is made ON when the current level of the signal current is converted into the voltage and then generates at the gate electrode of the conversion thin film insulated gate type field effect transistor said voltage referenced with the source electrode by electrically connecting the gate electrode and the drain electrode of the conversion insulated gate type field effect thin film transistor, and said switch thin film insulated gate type field effect transistor is made OFF to disconnect the gate electrode of the conversion thin film insulated gate type field effect transistor and the capacitor when restoring the voltage to said capacitor.

26. The method for driving a picture element as claimed in claim 19, wherein said light emitting device is an organic electroluminescence device.

27. The method for driving a picture element as claimed in claim 19, wherein said source, drain and channel of both said drive thin film insulated gate type field effect transistor and said conversion thin film insulated gate type field effect transistor are formed with poly-crystal semiconductor thin films.

28. An active matrix type display apparatus comprising:

a scanning line drive circuit for sequentially selecting scanning lines;

a data line drive circuit for sequentially supplying signal current corresponding to an intensity information to data lines; and a plurality of picture elements provided at each cross point of said "data line" and said scanning lines and each of the picture elements having a current drive type light emitting device which emits light in response to drive current corresponding to said signal current, wherein each of said picture element comprises:

an input thin film transistor connected to said data line;

a conversion thin film transistor connected to said input thin film transistor for converting said signal current on said data line to corresponding voltage;

a switch thin film transistor connected between a gate electrode and a source electrode of said conversion thin film transistor;

a capacitor connected to said gate electrode of said conversion thin film transistor for restoring said corresponding voltage; and a drive thin film transistor connected to said light emitting device and to aid capacitor, wherein a threshold voltage of said drive thin film transistor is set not to become lower than a threshold voltage of said conversion thin film transistor within one the picture element.

* * * * *

UNITED STATES PATENT AND TRADEMARK OFFICE

CERTIFICATE OF CORRECTION

PATENT NO. : 6,501,466 B1
DATED : December 31, 2002
INVENTOR(S) : Machio Yamagishi It is certified that error appears in the above-identified patent and that said Letters Patent is hereby corrected as shown below:

Column 13,
Line 51, replace “works in a saturation” with -- works in the saturation --.

Column 18,
Line 35, replace “device and to aid” with -- device and to said --.

Signed and Sealed this

Seventh Day of October, 2003

JAMES E. ROGAN
*Director of the United States Patent and Trademark Office*